US007955539B2

(12) United States Patent
Patel et al.

(10) Patent No.: US 7,955,539 B2
(45) Date of Patent: Jun. 7, 2011

(54) REVERSIBLE, HEAT-SET, ELASTIC FIBERS, AND METHOD OF MAKING AND ARTICLE MADE FROM SAME

(75) Inventors: Rajen M. Patel, Lake Jackson, TX (US); Rona L Reid, Houston, TX (US); Antonio Batistini, Zurich (CH); Selim Bensason, Houston, TX (US); Thoi H. Ho, Lake Jackson, TX (US)

(73) Assignee: Dow Global Technologies LLC, Midland, MI (US)

( * ) Notice: Subject to any disclaimer, the term of this patent is extended or adjusted under 35 U.S.C. 154(b) by 1519 days.

(21) Appl. No.: 10/507,230

(22) PCT Filed: Mar. 11, 2003

(86) PCT No.: PCT/US03/07591

§ 371 (c)(1),
(2), (4) Date: Sep. 9, 2004

(87) PCT Pub. No.: WO03/078705

PCT Pub. Date: Sep. 25, 2003

(65) Prior Publication Data

US 2005/0165193 A1 Jul. 28, 2005

(51) Int. Cl.

| | |
|---|---|
| ***B29C 45/14*** | (2006.01) |
| ***B29C 41/00*** | (2006.01) |
| ***D06C 3/00*** | (2006.01) |
| *D03D 15/04* | (2006.01) |
| *D04H 1/00* | (2006.01) |
| *D06B 1/02* | (2006.01) |

(52) U.S. Cl. ..... 264/172.11; 264/230; 28/156; 28/172.2; 442/328; 8/149.2

(58) Field of Classification Search ..... 264/172.11, 264/230; 28/156, 172.2; 442/328; 8/149.2
See application file for complete search history.

(56) References Cited

U.S. PATENT DOCUMENTS 2,037,512 A * 4/1936 Kahlisch ..... 28/195
(Continued)

FOREIGN PATENT DOCUMENTS

EP 0 515 203 A2 5/1992
(Continued)

OTHER PUBLICATIONS

Wild, et al., *Journal of Polymer Science, Polymer Physics Edition*, vol. 20, p. 441 (1982).

(Continued)

*Primary Examiner* — Monica A Huson
*Assistant Examiner* — Michael T Piery

(57) ABSTRACT

A reversible, heat-set covered fiber is described, the covered fiber comprising: A. A core comprising an elastic fiber comprising a substantially crosslinked, temperature-stable, olefin polymer, and B. A cover comprising an inelastic fiber. The fiber is heat-set by a method comprising: (a) Stretching the covered fiber by applying a stretching force to the covered fiber; (b) Heating the stretched covered fiber of (a) to a temperature in excess of the crystalline melting point of the olefin polymer for a period of time sufficient to at least partially melt the olefin polymer; (c) Cooling the stretched and heated covered fiber of (b) to a temperature below the crystalline melting point of the olefin polymer for a period of time sufficient to solidify the polymer; and (d) Removing the stretching force from the covered fiber.

2 Claims, 4 Drawing Sheets

U.S. PATENT DOCUMENTS

| | | | | | |
|---|---|---|---|---|---|
| 2,919,534 | A | * | 1/1960 | Bolinger et al. | 57/246 |
| 3,315,328 | A | | 4/1967 | Ibrahim | |
| 3,325,876 | A | | 6/1967 | Ibrahim | |
| 3,487,628 | A | | 1/1970 | Csok et al. | |
| 3,520,861 | A | | 7/1970 | Thomson et al. | |
| 3,645,992 | A | | 2/1972 | Elston et al. | |
| RE28,117 | E | * | 8/1974 | Rice | 57/288 |
| RE29,572 | E | * | 3/1978 | Usdan | 57/247 |
| 4,322,027 | A | | 3/1982 | Reba | |
| 4,340,563 | A | | 7/1982 | Appeal et al. | |
| 4,413,110 | A | | 11/1983 | Kavesh et al. | |
| 4,599,392 | A | | 7/1986 | McKinney et al. | |
| 4,663,220 | A | | 5/1987 | Wisneski et al. | |
| 4,668,566 | A | | 5/1987 | Braun | |
| 4,798,081 | A | | 1/1989 | Hazlitt et al. | |
| 4,798,880 | A | * | 1/1989 | Lodoen | 528/63 |
| 4,988,781 | A | | 1/1991 | McKinney et al. | |
| 5,008,204 | A | | 4/1991 | Stehling | |
| 5,026,798 | A | | 6/1991 | Canich | |
| 5,055,438 | A | | 10/1991 | Canich | |
| 5,064,802 | A | | 11/1991 | Stevens et al. | |
| 5,089,321 | A | | 2/1992 | Chum et al. | |
| 5,108,820 | A | | 4/1992 | Kaneko et al. | |
| 5,116,662 | A | * | 5/1992 | Morman | 428/198 |
| 5,272,236 | A | | 12/1993 | Lai et al. | |
| 5,278,272 | A | | 1/1994 | Lai et al. | |
| 5,292,845 | A | | 3/1994 | Kawasaki et al. | |
| 5,322,728 | A | | 6/1994 | Davey et al. | |
| 5,324,576 | A | | 6/1994 | Reed et al. | |
| 5,336,552 | A | | 8/1994 | Strack et al. | |
| 5,340,902 | A | * | 8/1994 | Smith et al. | 528/61 |
| 5,380,810 | A | | 1/1995 | Lai et al. | |
| 5,382,400 | A | | 1/1995 | Pike et al. | |
| 5,384,373 | A | | 1/1995 | McKinney et al. | |
| 5,472,775 | A | | 12/1995 | Obijeski et al. | |
| 5,525,257 | A | | 6/1996 | Kleinstuck et al. | |
| 5,645,542 | A | | 7/1997 | Anjur et al. | |
| 5,665,800 | A | | 9/1997 | Lai et al. | |
| 5,824,718 | A | | 10/1998 | Penfold et al. | |
| 5,883,188 | A | | 3/1999 | Hwang et al. | |
| 5,986,028 | A | | 11/1999 | Lai et al. | |
| 6,025,448 | A | | 2/2000 | Swindoll et al. | |
| 6,140,442 | A | | 10/2000 | Knight et al. | |
| 6,172,165 | B1 | | 1/2001 | Hucul et al. | |
| 6,194,532 | B1 | | 2/2001 | Maugans et al. | |
| 6,211,302 | B1 | | 4/2001 | Ho et al. | |
| 6,225,243 | B1 | | 5/2001 | Austin | |
| 6,248,355 | B1 | | 6/2001 | Seth | |
| 6,284,842 | B1 | | 9/2001 | Ho et al. | |
| 6,436,534 | B1 | | 8/2002 | Knight et al. | |
| 6,500,540 | B1 | | 12/2002 | Langohr et al. | |
| 6,623,585 | B2 | * | 9/2003 | Umezawa et al. | 156/167 |

FOREIGN PATENT DOCUMENTS

| | | | |
|---|---|---|---|
| EP | 0 490 854 | B1 | 9/1996 |
| EP | 0 748 846 | A2 | 12/1996 |
| EP | 0 416 815 | B1 | 8/1997 |
| EP | 1 273 606 | A | 1/2003 |
| WO | 90/01521 | | 2/1990 |
| WO | 99/11688 | | 3/1999 |
| WO | 99/60060 | | 11/1999 |
| WO | 99/63021 | | 12/1999 |
| WO | 01/85843 | A | 11/2001 |

OTHER PUBLICATIONS

L.D. Cady, "The Role of Comonomer Type and Distribution in LLDPE Product Performance," SPE Regional Technical Conference, Quaker Square Hilton, Akron, Ohio, Oct. 1-2, pp. 107-119 (1985).

J.C. Randall, *Rev. Macromol. Chem. Phys.*, C29, pp. 201-317.

M. Shida, R.N. Shroff and L.V. Cancio in *Polymer Engineering Science*, vol. 17, No. 11, p. 770 (1977).

John Dealy, *Rheometers for Molten Plastics* (1982) pp. 97-99, Published by Van Nostrand Reinhold Co.

D.M. Bigg, Effect of Copolymer Ratio on the Crystallinity and Properties of Polylactic Acid Copolymers, R.G. Barry Corporation, Columbus, OH.

* cited by examiner

REDENIERING EFFICIENCY AT 2x DRAFT and 2 min EXPOSURE

REVERSIBLE, HEAT-SET, ELASTIC FIBERS, AND METHOD OF MAKING AND ARTICLE MADE FROM SAME

FIELD OF THE INVENTION

This invention relates to elastic fibers, fabrics and other articles with novel heat set properties. In one aspect, the invention relates to elastic fibers that can be heat-set while in another aspect, the invention relates to elastic fibers that can be reversibly heat-set. These fibers can be used to make woven or knitted fabrics or nonwoven materials. In yet another aspect, the invention relates to covered fibers comprising an elastic core and an inelastic cover while in still another aspect, the invention relates to such fibers in which the core is a crosslinked polymer, e.g., an olefin polymer, and the cover is a natural fiber, e.g., cotton or wool. Other aspects of the invention include a method of making the covered fiber, a method of dying the covered fiber, a method of making the covered fiber into a woven or knitted fabric, and articles made from the covered fibers.

BACKGROUND OF THE INVENTION

Fibers with excellent elasticity are needed to manufacture a variety of fabrics which are used, in turn, to manufacture a variety of durable articles such as, for example, sport apparel, furniture upholstery and hygiene articles. Elasticity is a performance attribute, and it is one measure of the ability of a fabric to conform to the body of a wearer or to the frame of an item. Preferably, the fabric will maintain its conforming fit during repeated use, e.g., during repeated extensions and retractions at body and other elevated temperatures (such as those experienced during the washing and drying of the fabric).

Fibers are typically characterized as elastic if they have a high percent elastic recovery (that is, a low percent permanent set) after application of a biasing force. Ideally, elastic materials are characterized by a combination of three important properties: (i) a low percent permanent set, (ii) a low stress or load at strain, and (iii) a low percent stress or load relaxation. In other words, elastic materials are characterized as having the following properties (i) a low stress or load requirement (i.e., a low biasing force) to stretch the material, (ii) no or low relaxing of the stress or unloading once the material is stretched, and (iii) complete or high recovery to original dimensions after the stretching, biasing or straining force is discontinued.

Heat-setting is the process of exposing a fiber or article made from the fiber, e.g., a fabric, while under dimensional constraint to an elevated temperature, typically a temperature higher than any temperature that the fiber or article is likely to experience in subsequent processing (e.g., dyeing) or use (e.g., washing, drying and/or ironing). The purpose of heat-setting a fiber or article is to impart to it dimensional stability, e.g., prevention of or inhibition against stretching or shrinkage. The structural mechanics of heat-setting depend upon a number of factors including fiber morphology, fiber cohesive interactions and thermal transitions.

Elastic fibers, both covered and uncovered, are typically stretched during knitting, weaving and the like, i.e., they experience a biasing force that results in an elongation or lengthening of the fiber. Large degrees of stretch, even at ambient temperature, produces a permanent set, i.e., part of the applied stretch is not recovered when the biasing force is released. Exposure of the stretched fiber to heat can increase the permanent set, thus resulting in a fiber that is "heat-set".

The fiber thus assumes a new relaxed length which is longer than its original, pre-stretched length. Based on the conservation of volume, the new denier, i.e., fiber diameter, is lowered by a factor of the permanent stretch, i.e., the new denier is equal to the original denier divided by the permanent stretch ratio. This is known as "redeniering", and it is considered an important performance attribute of elastic fibers and fabrics made from the fibers. The processes of heat-setting and redeniering a fiber or an article is more fully described in the heat-setting experiments reported in the Preferred Embodiments.

Spandex is a segmented polyurethane elastic material known to exhibit nearly ideal elastic properties. However, spandex exhibits poor environmental resistance to ozone, chlorine and high temperatures, especially in the presence of moisture. Such properties, particularly the lack of resistance to chlorine, causes spandex to pose distinct disadvantages in apparel applications, such as swimwear and in white garments that are desirably laundered in the presence of chlorine bleach.

Moreover, because of its hard domain/soft domain segmented structure, a spandex fiber does not reversibly heat-set. In spandex, heat setting involves molecular bond breaking and reformation. The fiber does not retain any "memory" of its original length and, consequently, it does not have any driving force to return it to a pre-heat orientation. The heat setting is not reversible.

Elastic fibers and other materials comprising polyolefins, including homogeneously branched linear or substantially linear ethylene/∀-olefin interpolymers, are known, e.g., U.S. Pat. Nos. 5,272,236, 5,278,272, 5,322,728, 5,380,810, 5,472,775, 5,645,542, 6,140,442 and 6,225,243. These materials are also known to exhibit good resistance to ozone, chlorine and high temperature, especially in the presence of moisture. However, polyolefin polymer materials are also known to shrink upon exposure to elevated temperatures, i.e., temperatures in excess of ambient or room temperature.

The concept of crosslinking polyethylene to increase its high temperature stability is known. WO 99/63021 and U.S. Pat. No. 6,500,540 describe elastic articles comprising substantially cured, irradiated or crosslinked (or curable, irradiatable or crosslinkable) homogeneously branched ethylene interpolymers characterized by a density of less than 0.90 g/cc and optionally containing at least one nitrogen-stabilizer. These articles are useful in applications in which good elasticity must be maintained at elevated processing temperatures and after laundering.

SUMMARY OF THE INVENTION

According to this invention, a reversed, heat-set elastic fiber is described. The fiber comprises a temperature-stable polymer, e.g., a thermoplastic urethane or olefin. The fiber may comprise a blend of polymers; it can have a homofil, bicomponent or multicomponent configuration; and it can be formed into a yarn.

In one embodiment, the invention is a method of making a reversed, heat-set yarn, the yarn comprising:

A. An elastic fiber comprising a temperature-stable polymer having a melting point; and B. An inelastic fiber;

the method comprising:

(a) Stretching the elastic fiber by applying a stretching force to the fiber;

(b) Converting the stretched elastic fiber of (a) into a yarn;

(c) Winding the yarn of (b) onto a package;

(d) Heating the yarn of (c) to a temperature at which at least a portion of the crystallites of the polymer are molten; and (e) Cooling the yarn of (d) to a temperature below the temperature of step (d).

In another embodiment, the invention is a reversible, heat-set covered fiber, the covered fiber comprising:

A. A core comprising an elastic fiber comprising a substantially crosslinked, temperature-stable, olefin polymer; and B. A cover comprising an inelastic fiber.

In another embodiment, the invention is a method of making a reversible, heat-set covered fiber, the covered fiber comprising:

A. A core comprising an elastic fiber comprising a substantially crosslinked, temperature-stable, olefin polymer having a crystalline melting point; and B. A cover comprising an inelastic fiber;

the method comprising:

(a) Stretching the covered fiber by applying a stretching force to the covered fiber;

(b) Heating the stretched covered fiber of (a) to a temperature at which at least a portion of the crystallites of the olefin polymer are molten for a period of time sufficient to at least partially melt the olefin polymer;

(c) Cooling the stretched and heated covered fiber of (b) to a temperature below the temperature of step (b) for a period of time sufficient to solidify the polymer; and (d) Removing the stretching force from the covered fiber.

In one embodiment, the reversible, heat-set covered fiber is stretched to at least twice its pre-stretched length while in another embodiment, the stretched covered fiber is heated to at least about 5 C over the crystalline melting point of the olefin polymer.

In another embodiment, the invention is a heat-settable or heat-set fabric comprising a reversible, heat-settable or heat-set covered fiber, the covered fiber comprising:

A. A core comprising an elastic fiber comprising a substantially crosslinked, temperature-stable, olefin polymer; and B. A cover comprising an inelastic fiber.

In another embodiment, the invention is a heat-set fabric comprising a reversed, heat-set covered fiber, the covered fiber comprising:

A. A core comprising an elastic fiber comprising a substantially crosslinked, temperature-stable, olefin polymer; and B. A cover comprising an inelastic fiber.

In another embodiment, the invention is a stretchable nonwoven fabric comprising:

A. a web or fabric having a structure of individual fibers or threads which are randomly interlaid, wherein the fibers comprise an elastic fiber comprising a substantially crosslinked, temperature-stable, polymer, and optionally B. an inelastic film or nonwoven layer.

Such nonwoven fabric could be made by another embodiment of the invention which is a method for making the nonwoven fabric comprising:

a) forming a reversible heat set elastic web or fabric having a structure of individual polymeric fibers or threads which are randomly interlaid;

b) heat-setting the web or fabric by heating it to a temperature at which at least a portion of the polymer crystallites become molten while applying force to stretch the web or fabric;

c) laminating the fabric of step c) to an inelastic layer while the fabric of step c) is still in a stretched state from the heat-setting procedure;

d) cooling the laminated structure while still in a stretched state;

e) reheating the laminated structure to allow the reversibly heat set layer to at least partially contract towards its pre-stretched state.

In another embodiment, the invention is a method of dyeing a reversible, heat-settable covered fiber, the covered fiber comprising:

A. A core comprising an elastic fiber comprising a substantially crosslinked, temperature-stable, olefin polymer having a crystalline melting point; and B. A cover comprising an inelastic fiber;

the method comprising:

(a) Heat-setting the covered fiber, (b) Winding the heat-set, covered fiber onto a spool; and (c) Dyeing the heat-set, covered fiber while it is on the spool.

In another embodiment, the invention is a method of weaving a fabric from a dyed, reversible, heat-settable covered fiber, the covered fiber comprising:

A. A core comprising an elastic fiber comprising a substantially crosslinked, temperature-stable, olefin polymer having a crystalline melting point; and B. A cover comprising an inelastic fiber;

the method comprising:

(a) Heat-setting the covered fiber;

(b) Winding the heat-set, covered fiber onto a spool;

(c) Dyeing the heat-set, covered fiber while it is on the spool;

(d) Weaving a fabric from the dyed, heat-set covered fiber; and (e) Reversing the heat-set of the covered fiber after the fabric is woven.

In a variation on this embodiment, the invention is a method of weaving a fabric from a dyed, reversible, heat-settable covered fiber, the covered fiber comprising:

A. A core comprising an elastic fiber comprising a substantially crosslinked, temperature-stable, olefin polymer having a crystalline melting point; and B. A cover comprising an inelastic fiber;

the method comprising:

(a) Winding the heat-set, covered fiber onto a spool;

(b) Dyeing the heat-set, covered fiber at a temperature at which at least a portion of the crystallites of the olefin polymer are molten while the fiber is on the spool;

(c) Weaving a fabric from the dyed, heat-set covered fiber; and (d) Reversing the heat-set of the covered fiber after the fabric is woven.

The heat-set covered fiber can be woven into the fabric in the weft, warp or both directions. If the fabric is knitted, then the heat-set covered fiber can be incorporated into the fabric with or without an application of tension to the fiber. The heat-set covered fiber can be used in warp-knitting or weft-knitting applications.

In another embodiment, the invention is a reversed, heat-set elastic material, e.g., a film or nonwoven fabric, comprising:

A. An elastic material comprising a substantially crosslinked, temperature-stable olefin polymer; and B. An inelastic material.

Representative of the olefin polymers that can be used as the elastic fiber in this invention are the homogeneously branched ethylene polymers and the homogeneously branched, substantially linear ethylene polymers. Representative of the inelastic fibers that can be used as the cover are the natural fibers, e.g., cotton or wool.

Covered fibers comprise a core and a cover. For purposes of this invention, the core comprises one or more elastic fibers, and the cover comprises one or more inelastic fibers. At the time of the construction of the covered fiber and in their respective unstretched states, the cover is longer, typically significantly longer, than the core fiber. The cover surrounds the core in a conventional manner, typically in a spiral wrap configuration. Uncovered fibers are fibers without a cover. For purposes of this invention, a braided fiber or yarn, i.e., a fiber consisting of two or more fiber strands or filaments (elastic and/or inelastic) of about equal length in their respective unstretched states intertwined with or twisted about one another, is not a covered fiber. These yarns can, however, be used as either or both the core and cover of the covered fiber. For purposes of this invention, fibers consisting of an elastic core wrapped in an elastic cover are not covered fibers.

Full or substantial reversibility of heat-set stretch imparted to a fiber or fabric made from the fiber can be a useful property. For example, if a covered fiber can be heat-set before dyeing and/or weaving, then the dyeing and/or weaving processes are more efficient because the fiber is less likely to stretch during winding operations. This, in turn, can be useful in dyeing and weaving operations in which the fiber is first wound onto a spool. Once the dyeing and/or weaving is completed, then the covered fiber or fabric comprising the covered fiber can be relaxed. Not only does this technique reduce the amount of fiber necessary for a particular weaving operation, but it will also guard against subsequent shrinkage.

In an alternative embodiment of this invention, an elastic, reversible heat-set, uncovered fiber is co-knitted or woven with a hard (i.e., inelastic) fiber or yarn, e.g., side-by-side in a knit or in one or both directions of a weave, to produce a fabric that is reversibly heat-set. In another alternative embodiment the reversible heat-set fiber can be made into a nonwoven layer, then laminated to an inelastic film or nonwoven.

DETAILED DESCRIPTION OF THE INVENTION

General Definitions

Figure 1:
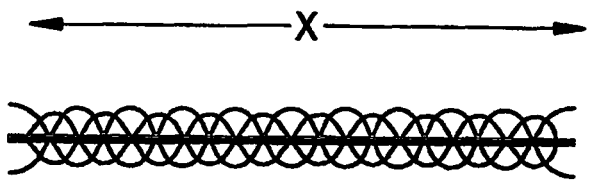
FIG. 1 is a schematic illustration of a pre-stretched covered fiber comprising an elastic core and an inelastic cover.

"Fiber" means a material in which the length to diameter ratio is greater than about 10. Fiber is typically classified according to its diameter. Filament fiber is generally defined as having an individual fiber diameter greater than about 15 denier, usually greater than about 30 denier. Fine denier fiber generally refers to a fiber having a diameter less than about 15 denier. Microdenier fiber is generally defined as fiber having a diameter less than about 100 microns denier.

"Filament fiber" or "monofilament fiber" means a single continuous strand of material of indefinite (i.e., not predetermined) length, as opposed to a "staple fiber" which is a discontinuous strand of material of definite length (i.e., a strand which has been cut or otherwise divided into segments of a predetermined length). "Multifilament fiber" means a fiber comprising two or more monofilaments.

"Photoinitiator" means a chemical composition that, upon exposure to UV-radiation, generates radical sites on a polymer.

"Photocrosslinker" means a chemical composition that, in the presence of a radical-generating initiator, forms a covalent crosslink between two polymer chains.

"Photoinitiator/crosslinker" means a chemical composition that upon exposure to UV-radiation generates two or more reactive species (e.g., free radicals, carbenes, nitrenes, etc.) that can form a covalent crosslink between two polymer chains.

"UV-radiation", "UV-light" and similar terms mean the range of radiation over the electromagnetic spectrum from about 150 to about 700 nanometers in wavelength. For purposes of this invention, UV-radiation includes visible light.

"Temperature-stable" and similar terms mean that the fiber or other structure or article will substantially maintain its elasticity during repeated extensions and retractions after exposure to about 200 C, e.g., temperatures such as those experienced during the manufacture, processing (e.g., dyeing) and/or cleaning of a fabric made from the fiber or other structure or article.

"Elastic" means that a fiber will recover at least about 50 percent of its stretched length after the first pull and after the fourth to 100% strain (doubled the length). Elasticity can also be described by the "permanent set" of the fiber. Permanent set is the converse of elasticity. A fiber is stretched to a certain point and subsequently released to the original position before stretch, and then stretched again. The point at which the fiber begins to pull a load is designated as the percent permanent set. "Elastic materials" are also referred to in the art as "elastomers" and "elastomeric". Elastic material (sometimes referred to as an elastic article) includes the polymer itself as well as, but not limited to, the polymer in the form of a fiber, film, strip, tape, ribbon, sheet, coating, molding and the like. The preferred elastic material is fiber. The elastic material can be either cured or uncured, radiated or unradiated, and/or crosslinked or uncrosslinked. For heat reversibility, the elastic fiber is preferably substantially crosslinked or cured.

"Nonelastic material" means a material, e.g., a fiber, that is not elastic as defined above.

"Heat-setting" and similar terms mean a process in which fibers, yarns or fabrics are heated to a final crimp or molecular configuration so as to minimize changes in shape during use. A "heat-set" fiber or other article is a fiber or article that has experienced a heat-setting process. In one embodiment, a "heat-set" fiber or other article comprising a thermoplastic polymer has been stretched under a biasing force, heated to at least the lowest temperature at which at least a portion of the crystallites of the polymer are molten (hereinafter the "heat-set temperature")r, cooled to below the heat-set temperature, and then the biasing force removed. A "reversed heat-set fiber" is a heat-set fiber that has been reheated above the heat-set temperature of the polymer without a biasing force and that returns to or near its pre-stretched length. A "reversibly heat-settable fiber" or a "reversible heat-set fiber" is a fiber (or other structure, e.g., film) that if heat-set, then the heat-set property of the fiber can be reversed upon heating the fiber, in the absence of a biasing force, to a temperature above the melting point of the polymer from which the fiber is made.

"Radiated" or "irradiated" means that the elastic polymer or polymer composition or the shaped article comprised of the elastic polymer or elastic composition was subjected to at least 3 megarads (or the equivalent of 3 megarads) of radiation dosage whether or not it resulted in a measured decrease in percent xylene extractables (i.e., an increase in insoluble gel). Preferably, substantial crosslinking results from the irradiation. "Radiated" or "irradiated" may also refer to the use of UV-radiation at an appropriate dose level along with optional photoinitiators and photocrosslinkers to induce crosslinking.

"Substantially crosslinked" and similar terms mean that the polymer, shaped or in the form of an article, has xylene extractables of less than or equal to 70 weight percent (i.e., greater than or equal to 30 weight percent gel content), preferably less than or equal to 40 weight percent (i.e., greater than or equal to 60 weight percent gel content). Xylene extractables (and gel content) are determined in accordance with ASTM D-2765.

"Cured" and "substantially cured" mean that the polymer, shaped or in the form of an article, was subjected or exposed to a treatment which induced substantial crosslinking.

"Curable" and "crosslinkable" mean that the polymer, shaped or in the form of an article, is not cured or crosslinked and has not been subjected or exposed to treatment that has induced substantial crosslinking (although the polymer, shaped or in the form of an article, comprises additive(s) or functionality which will effectuate substantial crosslinking upon subjection or exposure to such treatment).

"Homofil fiber" means a fiber that has a single polymer region or domain over its length, and that does not have any other distinct polymer regions (as does a bicomponent fiber).

"Bicomponent fiber" means a fiber that has two or more distinct polymer regions or domains over its length. Bicomponent fibers are also know as conjugated or multicomponent fibers. The polymers are usually different from each other although two or more components may comprise the same polymer. The polymers are arranged in substantially distinct zones across the cross-section of the bicomponent fiber, and usually extend continuously along the length of the bicomponent fiber. The configuration of a bicomponent fiber can be, for example, a cover/core (or sheath/core) arrangement (in which one polymer is surrounded by another), a side by side arrangement, a pie arrangement or an "islands-in-the sea" arrangement. Bicomponent fibers are further described in U.S. Pat. Nos. 6,225,243, 6,140,442, 5,382,400, 5,336,552 and 5,108,820.

"Meltblown fibers" are fibers formed by extruding a molten thermoplastic polymer composition through a plurality of fine, usually circular, die capillaries as molten threads or filaments into converging high velocity gas streams (e.g., air) which function to attenuate the threads or filaments to reduced diameters. The filaments or threads are carried by the high velocity gas streams and deposited on a collecting surface to form a web of randomly dispersed fibers with average diameters generally smaller than 10 microns.

"Meltspun fibers" are fibers formed by melting at least one polymer and then drawing the fiber in the melt to a diameter (or other cross-section shape) less than the diameter (or other cross-section shape) of the die.

"Spunbond fibers" are fibers formed by extruding a molten thermoplastic polymer composition as filaments through a plurality of fine, usually circular, die capillaries of a spinneret. The diameter of the extruded filaments is rapidly reduced, and then the filaments are deposited onto a collecting surface to form a web of randomly dispersed fibers with average diameters generally between about 7 and about 30 microns.

"Nonwoven" means a web or fabric having a structure of individual fibers or threads which are randomly interlaid, but not in an identifiable manner as is the case of a knitted fabric. The elastic fiber of the present invention can be employed to prepare nonwoven structures as well as composite structures of elastic nonwoven fabric in combination with nonelastic materials.

"Yarn" means a continuous strand of textile fibers, filaments, or material in a form suitable for knitting, weaving, or otherwise intertwining to form a textile fabric. The continuous length can comprise two or more fibers that are twisted or otherwise entangled with one another. A "covered" yarn or fiber means a compound structure which contains distinguishable inner ("core") and outer ("cover") fibrous elements which can be different One, none or both of the core and the cover of the covered fibers of this invention can comprise a yarn. If the core is a yarn, then all of the monofilaments making up the core yarn should be elastic.

Polymers

Any temperature-stable, elastic polymer that exhibits reversible heat-settability can be used in the practice of this invention. Accordingly, the polymer should have a crystalline melting point, for applicability in this invention. The preferred class of suitable polymers are crosslinked thermoplastic polyolefins.

While a variety of polyolefin polymers can be used in the practice of this invention (e.g., polyethylene, polypropylene, polypropylene copolymers ethylene/styrene interpolymers (ESI), and catalytically modified polymers (CMP), e.g., partially or fully hydrogenated polystyrene or styrene/butadiene/styrene block copolymers, polyvinylcyclohexane, EPDM, ethylene polymers are the preferred polyolefin polymers. Homogeneously branched ethylene polymers are more preferred and homogeneously branched, substantially linear ethylene interpolymers are especially preferred.

"Polymer" means a polymeric compound prepared by polymerizing monomers, whether of the same or a different type. The generic term "polymer" embraces the terms "homopolymer," "copolymer," "terpolymer" as well as "interpolymer."

"Interpolymer" means a polymer prepared by the polymerization of at least two different types of monomers. The generic term "interpolymer" includes the term "copolymer" (which is usually employed to refer to a polymer prepared from two different monomers) as well as the term "terpolymer" (which is usually employed to refer to a polymer prepared from three different types of monomers).

"Polyolefin polymer" means a thermoplastic polymer derived from one or more simple olefins. The polyolefin polymer can bear one or more substituents, e.g., a functional group such as a carbonyl, sulfide, etc. For purposes of this invention, "olefins" include aliphatic, alicyclic and aromatic compounds having one or more double bonds. Representative olefins include ethylene, propylene, 1-butene, 1-hexene, 1-octene, 4-methyl-1-pentene, butadiene, cyclohexene, dicyclopentadiene, styrene, toluene, $\alpha$-methylstyrene and the like.

"Catalytically modified polymer" means a hydrogenated aromatic polymer such as those taught in U.S. Pat. No. 6,172,165. Illustrative CMPs include the hydrogenated block copolymers of a vinyl aromatic compound and a conjugated diene, e.g., a hydrogenated block copolymer of styrene and a conjugated diene.

The preferred polymers used in this invention are ethylene interpolymers of ethylene with at least one $C_3$-$C_{20}$ $\alpha$-olefin and/or $C_4$-$C_{18}$ diolefin and/or alkenylbenzene. Copolymers of ethylene and a $C_3$-$C_{12}$ α-olefin are especially preferred. Suitable unsaturated comonomers useful for polymerizing with ethylene include, for example, ethylenically unsaturated monomers, conjugated or nonconjugated dienes, polyenes, alkenylbenzenes, etc. Examples of such comonomers include $C_3$-$C_{20}$ α-olefins such as propylene, isobutylene, 1-butene, 1-hexene, 1-pentene, 4-methyl-1-pentene, 1-heptene, 1-octene, 1-nonene, 1-decene, and the like. Preferred comonomers include propylene, 1-butene, 1-pentene, 1-hexene, 4-methyl-1-pentene, 1-heptene, and 1-octene, and 1-octene is especially preferred. Other suitable monomers include styrene, halo- or alkyl-substituted styrenes, vinylbenzocyclobutane, 1,4-hexadiene, 1,7-octadiene, and naphthenics (e.g., cyclopentene, cyclohexene and cyclooctene).

Preferably, the ethylene interpolymer has a melt index of less than 50, more preferably of less than 10, gram/10 minute (g/10 min), as determined in accordance with ASTM D-1238, Condition 190 C/2.16 kilogram (kg).

The preferred ethylene interpolymer has a differential scanning calorimetry (DSC) crystallinity of less than 26, preferably less than or equal to 15, weight percent (wt %). The preferred homogeneously branched ethylene polymers (such as, but not limited to, substantially linear ethylene polymers) have a single melting peak between −30 and 150° C., as determined using DSC, as opposed to traditional Ziegler-catalyst polymerized heterogeneously branched ethylene polymers (e.g., LLDPE and ULDPE or VLDPE) which have two or more melting points. The single melting peak is determined using a differential scanning calorimeter standardized with indium and deionized water. The DSC method uses about 5-7 mg sample sizes, a "first heat" to about 180° C. which is held for 4 minutes, a cool down at 10 C/min to −30 C which is held for 3 minutes, and heat up at 10° C./min. to 150° C. to provide a "second heat" heat flow vs. temperature curve. Total heat of fusion of the polymer is calculated from the area under the curve.

"Homogeneously branched ethylene polymer" means an ethylene/∀-olefin interpolymer in which the comonomer(s) is (are) randomly distributed within a given polymer molecule, and in which substantially all of the polymer molecules have the same ethylene to comonomer molar ratio. The term refers to an ethylene interpolymer that is manufactured using so-called homogeneous or single-site catalyst systems known in the art as Ziegler vanadium, hafnium and zirconium catalyst systems, metallocene catalyst systems, or constrained geometry catalyst systems. These polymers have a narrow short chain branching distribution and an absence of long chain branching. Such "linear" uniformly branched or homogeneous polymers include those made as described in U.S. Pat. No. 3,645,992, and those made using so-called single-site catalysts in a batch reactor having relatively high ethylene concentrations (as described in U.S. Pat. Nos. 5,026,798 and 5,055,438), and those made using constrained geometry catalysts in a batch reactor also having relatively high olefin concentrations (as described in U.S. Pat. No. 5,064,802 and EP 0 416 815 A2). Suitable homogeneously branched linear ethylene polymers for use in the invention are sold under the designation of TAFMER by Mitsui Chemical Corporation and under the designations of EXACT and EXCEED by Exxon Chemical Company.

The homogeneously branched ethylene polymer prior to irradiation, cure or crosslinking has a density at 23 C of less than 0.90, preferably less than or equal to 0.89 and more preferably less than or equal to about 0.88, g/cm$^3$. The homogeneously branched ethylene polymer prior to irradiation, cure or crosslinking has a density at 23 C of greater than about 0.855, preferably greater than or equal to 0.860 and more preferably greater than or equal to about 0.865, g/cm$^3$, as measured in accordance with ASTM D792. At densities higher than 0.89 g/cm$^3$, the shrink-resistance at an elevated temperature (especially, low percent stress or load relaxation) is less than desirable. Ethylene interpolymers with a density of less than about 0.855 g/cm$^3$ are not preferred because they exhibit low tenacity, very low melting point and handling problems, e.g., blocking and tackiness (at least prior to crosslinking).

The homogeneously branched, ethylene polymers used in the practice of this invention have less than 15, preferably less than 10, more preferably less than 5, and most preferably about zero (0), weight percent of the polymer with a degree of short chain branching less than or equal to 10 methyls/1000 total carbons. In other words, the ethylene polymer does not contain any measurable high density polymer fraction (e.g., it does not contain a fraction having a density of equal to or greater than 0.94 g/cm$^3$), as determined, for example, by using a temperature rising elution fractionation (TREF) (also known as analytical temperature rising elution fractionation (ATREF)) technique, or infrared or $^{13}$C nuclear magnetic resonance (NMR) analysis. The composition (monomer) distribution (CD) of an ethylene interpolymer (also frequently called the short chain branching distribution (SCBD)) can be readily determined from TREF as described, for example, by Wild et al., *Journal of Polymer Science, Poly. Phys. Ed.*, Vol. 20, p. 441 (1982), or in U.S. Pat. No. 4,798,081 or 5,008,204; or by L. D. Cady, "The Role of Comonomer Type and Distribution in LLDPE Product Performance," SPE Regional Technical Conference, Quaker Square Hilton, Akron, Ohio, October 1-2, pp. 107-119 (1985). The composition distribution of the ethylene interpolymer can also be determined using $^{13}$C NMR analysis in accordance with techniques described in U.S. Pat. Nos. 5,292,845, 5,089,321 and 4,798,081, and by J. C. Randall, *Rev. Macromol. Chem. Phys.*, C29, pp. 201-317. The composition distribution and other compositional information can also be determined using crystallization analysis fractionation such as the CRYSTAF fractionalysis package available commercially from PolymerChar, Valencia, Spain.

The substantially linear ethylene polymers used in the present invention are a unique class of compounds that are further described in U.S. Pat. Nos. 5,272,236, 5,278,272, 5,665,800, 5,986,028 and 6,025,448.

Substantially linear ethylene polymers differ significantly from the class of polymers conventionally known as homogeneously branched linear ethylene polymers described above and, for example, U.S. Pat. No. 3,645,992. As an important distinction, substantially linear ethylene polymers do not have a linear polymer backbone in the conventional sense of the term "linear" as is the case for homogeneously branched linear ethylene polymers.

The preferred homogeneously branched, substantially linear ethylene polymer for use in the present invention is characterized as having (a) melt flow ratio, $I_{10}/I_2 \geqq 5.63$;

(b) a molecular weight distribution, $M_w/M_n$, as determined by gel permeation chromatography and defined by the equation:

$$(M_w/M_n) \leqq (I_{10}/I_2) - 4.63;$$

(c) a gas extrusion rheology such that the critical shear rate at onset of surface melt fracture for the substantially linear ethylene polymer is at least 50 percent greater than the critical shear rate at the onset of surface melt fracture for a linear ethylene polymer, in which the substantially linear ethylene polymer and the linear ethylene polymer comprise the same comonomer or comonomers, the linear ethylene polymer has an $I_2$ and $M_w/M_n$ within ten percent of the substantially linear ethylene polymer, and in which the respective critical shear rates of the substantially linear ethylene polymer and the linear ethylene polymer are measured at the same melt temperature using a gas extrusion rheometer;

(d) a single DSC melting peak between −30 and 150 C; and (e) a density less than or equal to about 0.890 g/cm$^3$.

Determination of the critical shear rate and critical shear stress in regards to melt fracture as well as other rheology properties such as "rheological processing index" (PI), is performed using a gas extrusion rheometer (GER). The gas extrusion rheometer is described by M. Shida, R. N. Shroff and L. V. Cancio in *Polymer Engineering Science*, Vol. 17, No. 11, p. 770 (1977) and in *Rheometers for Molten Plastics* by John Dealy, published by Van Nostrand Reinhold Co. (1982) on pp. 97-99. For substantially linear ethylene polymers, the PI is less than or equal to 70 percent of that of a conventional linear ethylene polymer having an $I_2$, $M_w/M_n$ and density each within ten percent of the substantially linear ethylene polymer.

In those embodiments of the invention in which at least one homogeneously branched ethylene polymer is used, the $M_w/M_n$ is preferably less than 3.5, more preferably less than 3.0, most preferably less than 2.5, and especially in the range of from about 1.5 to about 2.5 and most especially in the range from about 1.8 to about 2.3.

The polyolefin can be blended with other polymers. Suitable polymers for blending with the polyolefin are commercially available from a variety of suppliers and include, but are not limited to, other polyolefins such as an ethylene polymer (e.g., low density polyethylene (LDPE), ULDPE, medium density polyethylene (MDPE), LLDPE, HDPE, homogeneously branched linear ethylene polymer, substantially linear ethylene polymer, graft-modified ethylene polymer ESI, ethylene vinyl acetate interpolymer, ethylene acrylic acid interpolymer, ethylene ethyl acetate interpolymer, ethylene methacrylic acid interpolymer, ethylene methacrylic acid ionomer, and the like), polycarbonate, polystyrene, polypropylene (e.g., homopolymer polypropylene, polypropylene copolymer, random block polypropylene interpolymer and the like), thermoplastic polyurethane, polyamide, polylactic acid interpolymer, thermoplastic block polymer (e.g. styrene butadiene copolymer, styrene butadiene styrene triblock copolymer, styrene ethylene-butylene styrene triblock copolymer and the like), polyether block copolymer (e.g., PEBAX), copolyester polymer, polyester/polyether block polymers (e.g., HYTEL), ethylene carbon monoxide interpolymer (e.g., ethylene/carbon monoxide (ECO), copolymer, ethylene/acrylic acid/carbon monoxide (EAACO) terpolymer, ethylene/methacrylic acid/carbon monoxide (EMAACO) terpolymer, ethylene/vinyl acetate/carbon monoxide (EVACO) terpolymer and styrene/carbon monoxide (SCO)), polyethylene terephthalate (PET), chlorinated polyethylene, and the like and mixtures thereof. In other words, the polyolefin used in the practice of this invention can be a blend of two or more polyolefins, or a blend of one or more polyolefins with one or more polymers other than a polyolefin. If the polyolefin used in the practice of this invention is a blend of one or more polyolefins with one or more polymers other than a polyolefin, then the polyolefins comprise at least about 1, preferably at least about 50 and more preferably at least about 90, wt % of the total weight of the blend.

In one embodiment, the ethylene interpolymer is blended with a polypropylene polymer. Suitable polypropylene polymers for use in the invention include both elastic and inelastic polymers, including random block propylene ethylene polymers. Suitable polypropylene polymers are available from a number of manufacturers, such as, for example, Montell Polyolefins and Exxon Chemical Company. Suitable polypropylene polymers from Exxon are supplied under the designations ESCORENE and ACHIEVE.

Suitable graft-modified polymers for use in this invention are well known in the art, and include the various ethylene polymers bearing a maleic anhydride and/or another carbonyl-containing, ethylenically unsaturated organic radical. Representative graft-modified polymers are described in U.S. Pat. No. 5,883,188, such as a homogeneously branched ethylene polymer graft-modified with maleic anhydride.

Suitable polylactic acid (PLA) polymers for use in the invention are well known in the literature (e.g., see D. M. Bigg et al., "Effect of Copolymer Ratio on the Crystallinity and Properties of Polylactic Acid Copolymers", *ANTEC* '96, pp. 2028-2039; WO 90/01521; EP 0 515203A and EP 0 748 846 A2. Suitable polylactic acid polymers are supplied commercially by Cargill Dow under the designation EcoPLA.

Suitable thermoplastic polyurethane polymers for use in the invention are commercially available from The Dow Chemical Company under the designation PELLATHANE.

Suitable polyolefin carbon monoxide interpolymers can be manufactured using well known high pressure free-radical polymerization methods. However, they may also be manufactured using traditional Ziegler-Natta catalysis, or with the use of so-called homogeneous catalyst systems such as those described and referenced above.

Suitable free-radical initiated high pressure carbonyl-containing ethylene polymers such as ethylene acrylic acid interpolymers can be manufactured by any technique known in the art including the methods taught by Thomson and Waples in U.S. Pat. Nos. 3,520,861, 4,988,781; 4,599,392 and 5,384,373.

Suitable ethylene vinyl acetate interpolymers for use in the invention are commercially available from various suppliers, including Exxon Chemical Company and Du Pont Chemical Company.

Suitable ethylene/alkyl acrylate interpolymers are commercially available from various suppliers. Suitable ethylene/acrylic acid interpolymers are commercially available from The Dow Chemical Company under the designation PRIMACOR. Suitable ethylene/methacrylic acid interpolymers are commercially available from Du Pont Chemical Company under the designation NUCREL.

Chlorinated polyethylene (CPE), especially chlorinated substantially linear ethylene polymers, can be prepared by chlorinating polyethylene in accordance with well known techniques. Preferably, chlorinated polyethylene comprises equal to or greater than 30 weight percent chlorine. Suitable chlorinated polyethylenes for use in the invention are commercially supplied by The Dow Chemical Company under the designation TYRIN.

The blend of the polyolefin with one or more of these other polymer must retain, of course, sufficient elasticity so as to be heat-set reversible. If both the polyolefin and the blend polymer are of like elasticity, then the relative amounts of each can vary widely, e.g., 0:100 to 100.0 weigh percent. If the blend polymer has little or no elasticity, then the amount of blend polymer in the blend will depend upon the degree to which it dilutes the elasticity of the polyolefin. For blends in which the polyolefin is a homogeneously branched ethylene polymer, particularly a substantially linear homogeneously branched ethylene polymer and the blend polymer is an inelastic polymer, e.g., a crystalline polypropylene or PLA, the typical weight ratio of the polyolefin to blend polymer is between 99:1 and 90:10.

Similarly, the inelastic cover fiber can be blended with one or more of the blend polymers described above but if blended, then it is typically and preferably blended with another inelastic fiber, e.g., a crystalline polypropylene or PLA. If blended with an elastic fiber, then the amount of elastic fiber in the blend is limited so as not to impart an unwanted elasticity to the covered fiber.

Crosslinking

In the practice of this invention, crosslinking, curing or irradiation of the elastic polymer or articles comprising the elastic polymer can be accomplished by any means known in the art including but not limited to electron-beam, beta, gamma, UV- and corona irradiation; controlled thermal heating; peroxides; allyl compounds; and silicon (silane) and azide coupling, and mixtures thereof. Silane, Electron-beam and UV-irradiation (with and without the use of photoinitiators, photocrosslinkers and/or photoinitiator/crosslinkers) are the preferred techniques for substantially crosslinking or curing the polymer or article comprising the polymer. Suitable crosslinking, curing and irradiation techniques are taught in U.S. Pat. Nos. 6,211,302, 6,284,842, 5,824,718, 5,525,257 and 5,324,576, EP 0 490 854, and the provisional US patent application filed by Parvinder Walia et al. On Feb. 5, 2003.

Additives

Antioxidants, e.g., Irgafos 168, Irganox 1010, Irganox 3790, and chimassorb 944 made by Ciba Geigy Corp., may be added to the ethylene polymer to protect against undo degradation during shaping or fabrication operation and/or to better control the extent of grafting or crosslinking (i.e., inhibit excessive gelation). In-process additives, e.g. calcium stearate, water, fluoropolymers, etc., may also be used for purposes such as for the deactivation of residual catalyst and/or improved processability. Tinuvin 770 (from Ciba-Geigy) can be used as a light stabilizer.

The polyolefin polymer can be filled or unfilled. If filled, then the amount of filler present should not exceed an amount that would adversely affect either heat-resistance or elasticity at an elevated temperature. If present, typically the amount of filler is between 0.01 and 80 wt % based on the total weight of the polyolefin polymer (or if a blend of a polyolefin polymer and one or more other polymers, then the total weight of the blend). Representative fillers include kaolin clay, magnesium hydroxide, zinc oxide, silica and calcium carbonate. In a preferred embodiment, in which a filler is present, the filler is coated with a material that will prevent or retard any tendency that the filler might otherwise have to interfere with the crosslinking reactions. Stearic acid is illustrative of such a filler coating.

Fiber and Other Article Manufacture

The core fiber of the present invention can be a homofil or bicomponent fiber made by any process. Conventional processes for producing a homofil fiber include melt spun or melt blown using systems as disclosed in U.S. Pat. Nos. 4,340,563, 4,663,220, 4,668,566 or 4,322,027, and gel spun using the system disclosed in U.S. Pat. No. 4,413,110. The fibers can be melt spun into the final fiber diameter directly without additional drawing, or they can be melt spun into a higher diameter and subsequently hot or cold drawn to the desired diameter using conventional fiber drawing techniques.

Bicomponent fibers have the ethylene polymer in at least one portion of the fiber. For example, in a sheath/core bicomponent fiber (i.e., one in which the sheath concentrically surrounds the core), the ethylene polymer can be in either the sheath or the core. Typically and preferably, the ethylene polymer is the sheath component of the bicomponent fiber but if it is the core component, then the sheath component must be such that it does not prevent the crosslinking of the core, e.g., if UV-radiation will be used to crosslink the core then the sheath component should be transparent or translucent to UV-radiation such that sufficient UV-radiation can pass through it to substantially crosslink the core polymer. Different polymers can also be used independently as the sheath and the core in the same fiber, preferably where both components are elastic. Other types of bicomponent fibers are within the scope of the invention as well, and include such structures as side-by-side conjugated fibers (e.g., fibers having separate regions of polymers, wherein the polyolefin of the present invention comprises at least a portion of the fiber's surface).

The shape of the fiber is not limited. For example, typical fiber has a circular cross-sectional shape, but sometimes fibers have different shapes, such as a trilobal shape, or a flat (i.e., "ribbon" like) shape. The elastic core fiber of this invention is not limited by the shape of the fiber.

Fiber diameter can be measured and reported in a variety of fashions. Generally, fiber diameter is measured in denier per filament. Denier is a textile term which is defined as the grams of the fiber per 9000 meters of that fiber's length. For the elastic core fibers of this invention, the diameter can be widely varied, with little impact upon the elasticity of the fiber. The fiber denier, however, can be adjusted to suit the capabilities of the finished article and as such, would preferably be from about 1 to about 20,000 denier/filament for continuous wound filament. Nonetheless, preferably, the denier is greater than 20, and can advantageously be about 40 denier or about 70 denier. These preferences are due to the fact that typically durable apparel employ fibers with deniers greater than about 40.

Covered Fiber

The covered fibers of this invention comprise a core and a cover. For purposes of this invention, the core comprises one or more elastic fibers, and the cover comprises one or more inelastic fibers. As noted above, the elastic fiber comprises a homogeneously branched ethylene polymer. Typical cover fibers include natural fibers such as cotton, jute, wool, silk, and the like, or synthetic fibers such as polyesters (for example PET or PBT) or nylon. The covered fiber can be constructed in any typical fashion.

FIG. 1 shows a covered fiber in a pre-stretched state. The fiber comprises an elastic core encircled by an inelastic, spirally wound cover. In this state, the cover fiber is significantly longer than the core fiber.

Figure 2:
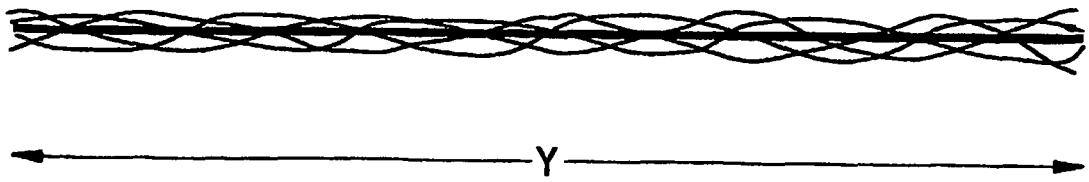
FIG. 2 is a schematic illustration of a post-stretched covered fiber comprising an elastic core and an inelastic cover.

FIG. 2 shows the covered fiber of FIG. 1 in a stretched or elongated state. Here, the difference in length between the core and cover fibers has been reduced by the lengthening of the core fiber. While the cover fiber does not stretch by any appreciable amount, if at all, the stretching of the core fiber removes some or all of the slack inherent in the wrap of the cover about the core.

Heat-setting the covered fiber comprises (i) stretching the core fiber by the application of a biasing force, (ii) heating the core fiber at least to a temperature at which at least a portion of the crystallites of the ethylene polymer comprising the core fiber are molten, (iii) holding the core fiber above the temperature of step (ii) until some or all of the ethylene polymer has melted, (iv) cooling the melted core fiber to a temperature below the temperature of step (ii), and (v) removing the biasing force from the fiber. The covered fiber is now in a "relaxed state" and depending upon the amount of stretch removed from the pre-stretched fiber, it will behave as a hard fiber or near-hard fiber. If the stretched heat-set covered fiber is heated again to a temperature above the temperature at which at least a portion of the crystallites of the olefin polymer are molten but without a biasing force, then the covered fiber will return to or near to its pre-stretched length. The fiber is then said to be a reversed heat-set fiber.

For the preferred polyethylene core fibers, the temperature of step (ii) should be at least 30° C., more preferably at least 40° C., and most preferably at least about 50° C.

Figure 3:
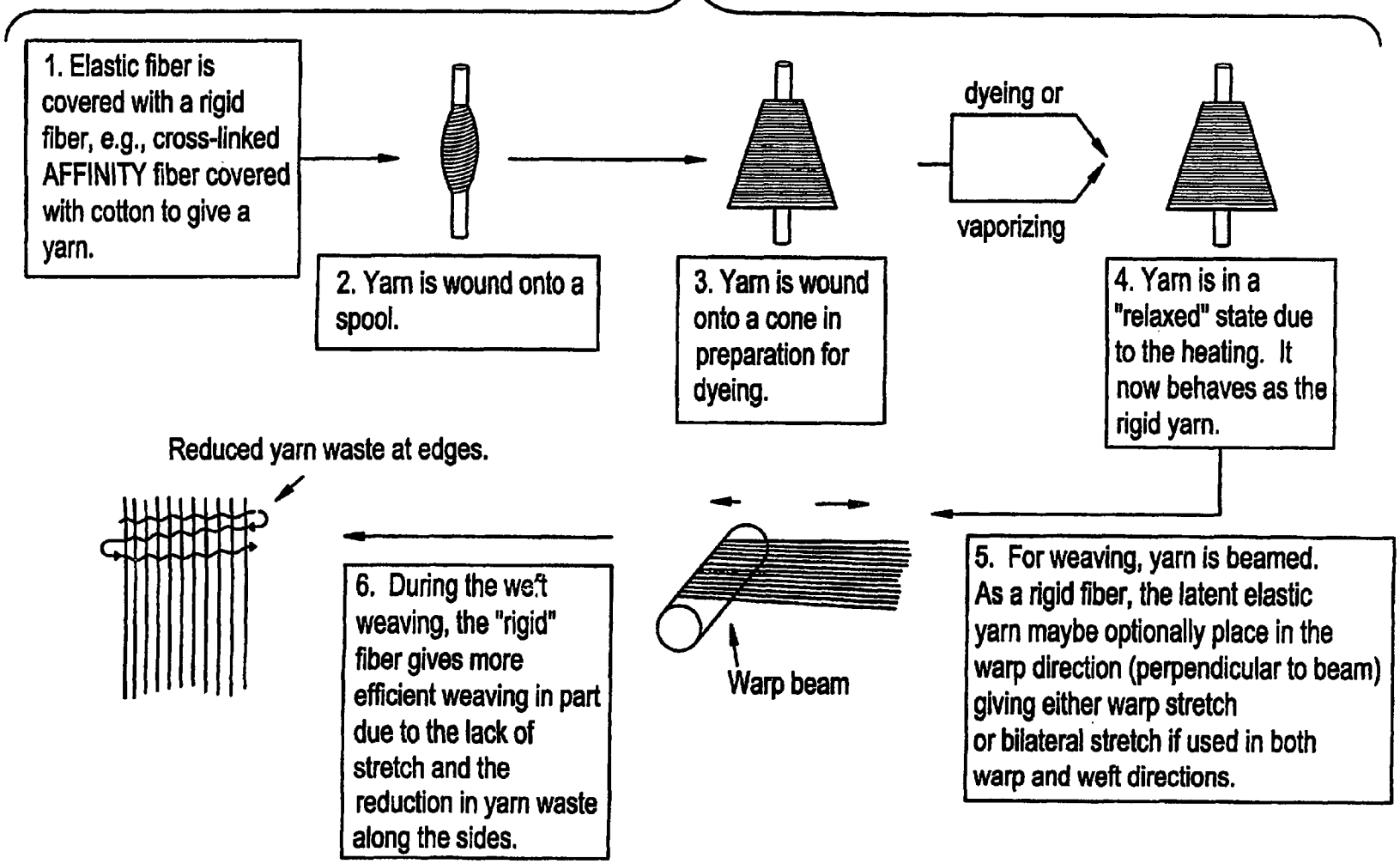
FIG. 3 is a schematic illustration of a process for dyeing and weaving a stretched and relaxed covered fiber.

Once heat-set and relaxed, the covered fiber behaves much like a hard fiber, and this adapts it well to efficient dyeing, warping, weaving or knitting. FIG. 3 provides an illustration of one embodiment of dyeing and weaving a stretched and relaxed covered fiber. After the covered fiber has been heat-set and relaxed, it is collected onto a spool. From the spool, it is transferred to a perforated cone in preparation for dyeing, dyed by any conventional technique, and then used in the weaving operation. Typically, the dyed covered fiber is inserted in the weft direction giving weft stretch. It may be optionally placed in the warp direction giving warp stretch. It may also be placed in both warp and weft directions giving bilateral stretch. During weft weaving, the rigid or "frozen" fiber gives more efficient weaving in part due to the lack of stretch and the reduction in yarn waste along the sides. In the preparation of knitted fabrics, the heat-set (or rigid or frozen) fiber or yarn can be incorporated into the fabric with or without the application of tension to the fiber or yarn.

Once fabric incorporating the heat-set covered yarn of the invention is obtained, the fabric can be subjected to a temperature at which at least some of the crystallites of the heat-set covered yarn are molten, in order to reverse the heat-set. Preferably the elevated temperature is applied as part of a wet textile processing step such as desizing, scouring or mercerizing. Preferably the temperature of the first step after the greige fabric is formed is less than about 70° C., more preferably between 40 and 60° C. It has been discovered that reversing the heat-set under such relatively low temperatures results in a fiber which maximizes the return towards its pre-stretched length. After the heat-set has been reversed, then the fiber can be exposed to higher temperatures without undue degradation in the elasticity.

Alternatively, the covered fiber may be wound onto a spool or cone in an extended or stretched state. During subsequent processes, such as dyeing, the temperature of the dye bath is sufficient to heat set the fiber. The heat set fibers may then be removed from the dyeing and used directly for other processing such as weaving or knitting. In the case of Lycra fibers, since they do not heat set during dyeing, the fiber shrinks and the cone can be crushed and further transferred onto different spools for weaving and knitting must occur. The reversible heat-set fiber or yarn of the invention significantly improves the manufacturing of elastic fabric because the elasticity of the yarn can be heat set, allowing it to be processed (dyed, woven, knitted, etc.) as an inelastic yarn and then the elasticity can be recovered after such processing.

The following examples are to illustrate the invention, and not to limit it. Ratios, parts and percentages are by weight unless otherwise stated.

DESCRIPTION OF THE PREFERRED EMBODIMENTS

Materials

ENGAGE polyethylene (0.87 g/cc, 5 MI) stabilized with 2000 ppm Chimassorb™ 944, 2000 ppm Cyanox™ 1790, 500 ppm of Irganox 1076 and 800 ppm Pepq. 70 denier spun using an 8-end line spinning apparatus. E-beam irradiated with a dose of 22.4 Mrad, in $N_2$ with external cooling.

Lycra 162C, 70 denier.

Heat-Setting Experiments

Fiber samples about 10-20 cm in length were cut from spools and taped at one end onto a Teflon™ coated sheet. The free end was then moved away from the fixed end until a desired stretch was reached, and then taped onto the sheet. The true stretch was measured from the separation of two reference marks placed about 5 cm apart in the mid portion of the fiber before stretching. The applied stretch ratio, $X_{app}$, is defined as $$X_{app} = \frac{\text{stretched length}}{\text{unstretched length}}$$

$X_{app}$ was 1.5, 2, 3 and 4 in this study (this corresponds to 50, 100, 200 and 300% elongation). The sheet was then inserted into a convection oven equilibrated at the desired heat-setting temperature in the range of 180 to 210 C. After an exposure time of 1, 2 or 3 minutes, the sheet was removed from the oven and placed on a surface at room temperature. The fibers reached room temperature in a few seconds. The tapes holding both ends of the fiber remained intact throughout the experiment, but some minor fiber slippage occurred when fibers are stretched, especially to high stretch ratios. This slippage did not influence the results because the fiber elongation is measured from the reference marks.

After the fibers reached room temperature, the sheets were curled to allow the fiber ends to come closer thereby allowing recovery with no constraint. The fibers were removed from the sheets after 5 minutes recovery time and the "set" stretch, defined as $$X_{set} = \frac{\text{set length}}{\text{unstretched length}}$$

was measured. The new denier of the fiber is:

$$\text{new denier} = \frac{\text{original denier}}{X_{set}}$$

Redeniering efficiency (percent) can be defined as:

$$Eff_{REDEN} = \frac{X_{set} - 1}{X_{app} - 1} \times 100$$

For Lycra two other effects were also considered with one experiment each: The effect of heat-setting in the presence of water, and the effect of applying the stretch in the oven rather than stretching at room temperature. All the above experiments were performed with 5 repeats, and the tabulated results are average values. The load-elongation curves were obtained with the standard protocol, at 500% $min^{-1}$ rate.

Free Shrinkage

The free (unconstrained) shrinkage of both heat-set and control fibers were measured by immersing fiber samples of about 20 cm initial length into a water bath kept at 90 C. The shrunk length was measured after the fiber reached room temperature. The percent at shrinkage is defined as:

$$S = \frac{\text{final length} - \text{initial length}}{\text{initial length}} \times 100$$

For heat set fibers the remaining stretch after shrinkage $X_{final}$ is $$X_{final} = \frac{\text{shrunk length}}{\text{original unstretched length}}$$

The overall efficiency (percent) of the heat setting process can be defined as:

$$\text{Efficiency} = \frac{X_{final} - 1}{X_{app} - 1} \times 100$$

The overall efficiency is equal to redeniering efficiency when shrinkage is zero.

Example Calculation

A 10 cm long fiber, originally 100 denier, is stretched to 20 cm.

$X_{app}=2$

The stretched fiber is heat-set, and the recovered length is measured as 15 cm.

$X_{set}=1.5$ new denier=66.7

$Eff_{REDEN}=50\%$

The 15 cm fiber is then exposed to 90 C water and shrinks to 14 cm.

S=6.7%

$X_{final}=1.4$

Eff=40%

Shrinkage Force Measurements

For samples of constrained length, the shrinkage force in 90 C water was measured using an apparatus for oriented shrink films. For these experiments bundles of 10 fibers were used to achieve a large enough force that can be measured accurately with the instrument. For heat-set samples, the fibers were kept at $X_{app}$, to simulate the constraint imposed by the fabric on the elastic fiber. After immersion into water, the force reading in all samples decayed rapidly to a steady value. The value at 10 seconds exposure time was recorded. Further relaxation of the retractive force with time is plausible for Lycra but not likely for AFFINITY fibers because the latter is crosslinked.

Results and Discussion

Heat-Setting and Redeniering

Data gathered for heat-setting experiments are summarized in Table I(a) for Lycra and in Table I(b) for AFFINITY. The following observations are made:

- For both fibers only partial redeniering is possible. The redeniering efficiency of AFFINITY is higher than that of Lycra at equivalent conditions.
- Redeniering efficiency decreases with increased stretch both for AFFINITY and Lycra.
- Redeniering efficiency increases with longer heat-setting time for Lycra, but it is not significantly affected for AFFINITY.
- Redeniering efficiency decreases significantly with reduced temperature for Lycra, but not for AFFINITY.
- Redeniering is not affected by the presence of water for Lycra. Also, applying the stretch at a heat-setting temperature did not produce different results from room temperature stretch and subsequent heat-setting. The data for this observation is not reported in Table 1.

Load-Elongation Curves

Figure 4:
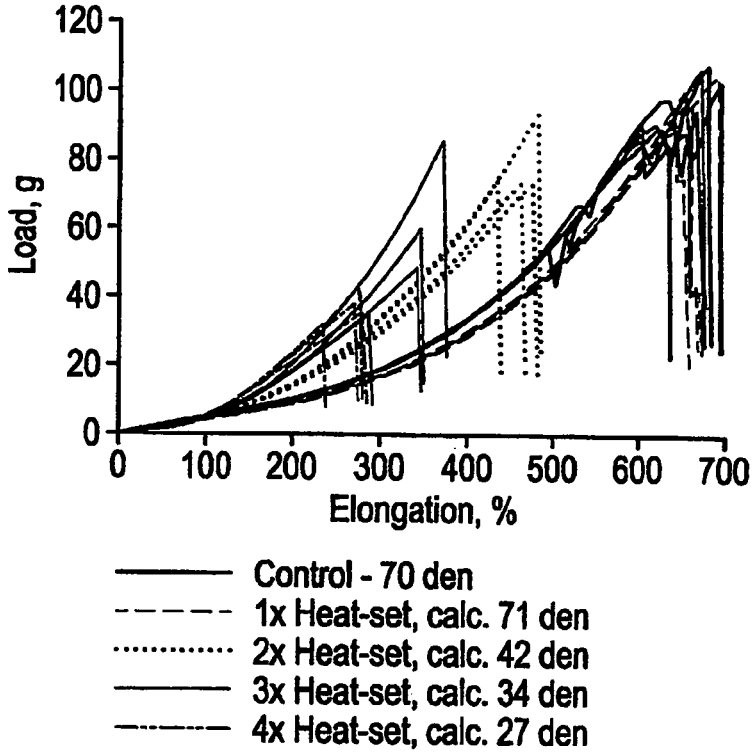
FIG. 4 reports load-elongation curves for Lycra heat-set at 200 C for 1 min.
Figure 5:
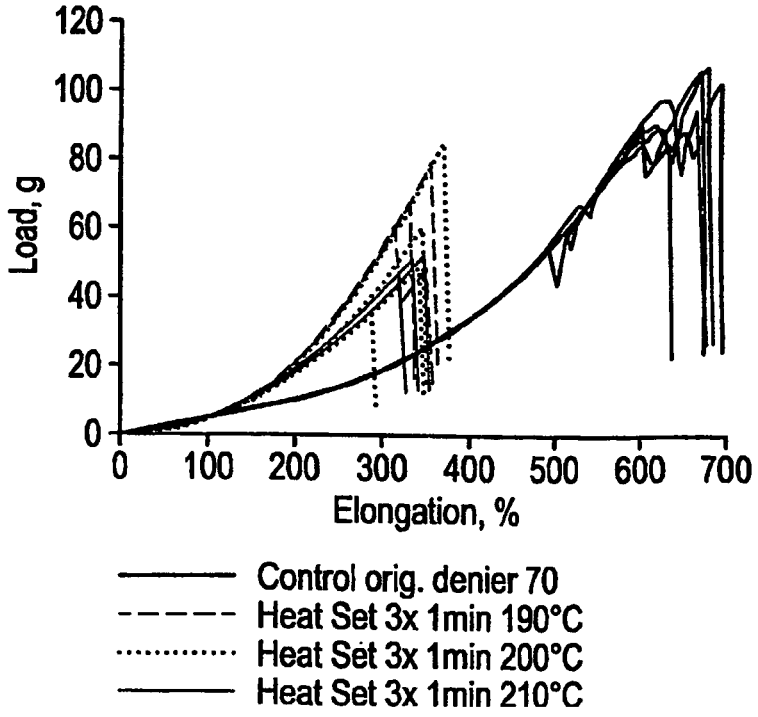
FIG. 5 reports the effect of heat-setting temperature on load-elongation curves for Lycra heat-set for 1 minute at 3× stretch ratio at 190, 200 and 210 C.
Figure 6:
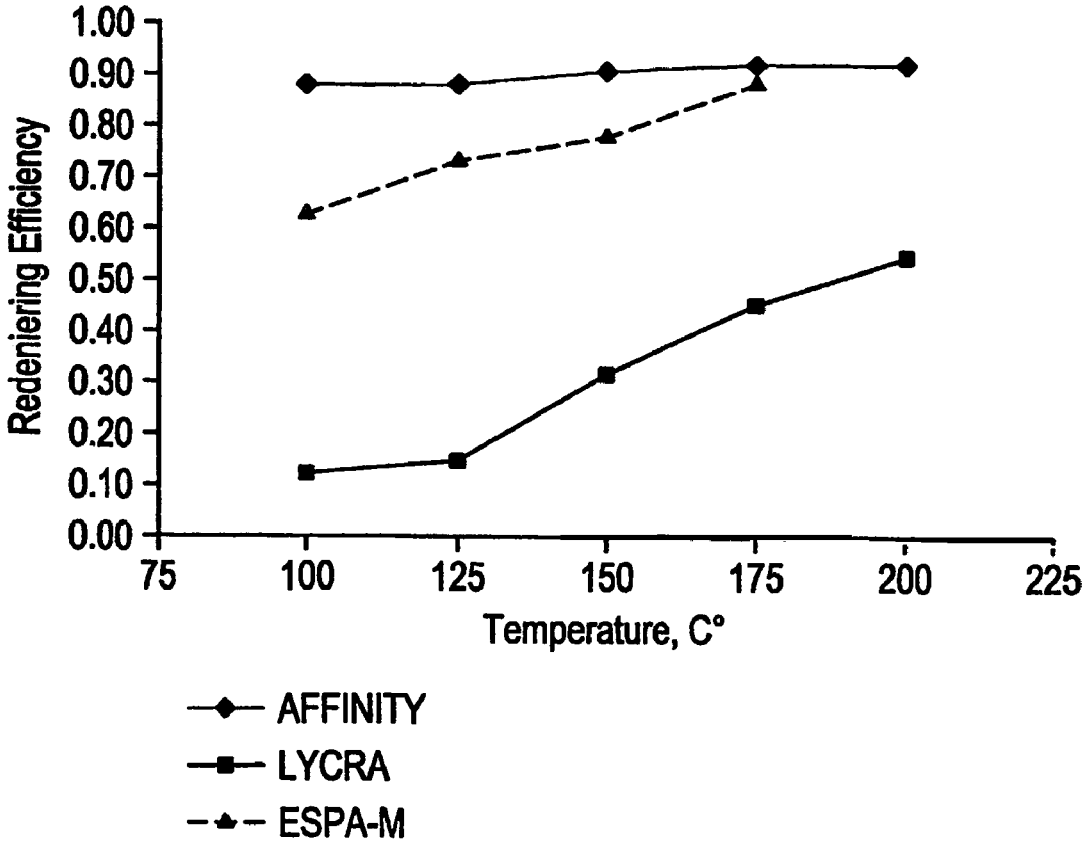
FIG. 6 is a graph of applied stretch ratio for AFFINITY heat-set at 200 C for 1 min.

The load-elongation curves obtained for the heat-set fibers are shown in FIGS. 4-6. FIG. 4 is on the effect of applied stretch ratio for Lycra heat-set at 200 C for 1 min. As seen in FIG. 4, the most significant consequence of heat-setting is the gradual decrease in extensibility with increasing stretch. The load at break decreased also, while the reduced load per actual denier increased with applied stretch. However from the fabric performance perspective, the load in grams per fiber is the relevant quantity regardless of denier. Interestingly, the initial modulus decreased with increased stretch while the opposite was true beyond 100% elongation.

FIG. 5 is on the effect heat-setting temperature for Lycra heat-set for 1 minute at 3× stretch ratio. Fibers exposed to 190, 200 and 210 C all had the about the same elongation at break. The load at break decreased with increasing temperature.

Finally, FIG. 6 is on the effect of applied stretch ratio for AFFINITY heat-set at 200° C. for 1 min. While the general features are similar to that of Lycra (FIG. 4), the elongation at break is reduced to about 100% strain for 4× stretch. This is not unexpected because the extensibility of control AFFINITY fibers are lower than that of Lycra by about 200%.

While stretch heat-setting generally increased the modulus of both AFFINITY and Lycra, the mechanical conditioning of the fibers by cyclic loading will reduce the loads significantly even after one cycle.

Free Shrinkage Experiments

The unconstrained shrinkage of fibers is useful to illustrate the shrinkage potential that remains in the fiber with or without heat treatments. However, the previous experiments do not directly relate to fabric shrinkage where elastic fibers are constrained by the textile structure and dimension. A fiber experiment that is more meaningful in this regard is the shrinkage force experiments reported here.

To put these experiments into context for AFFINITY fibers, an uncrosslinked AFFINITY fiber shrinks about 80 to 90% if it exposed to 90 C water. The shrinkage is is due to orientation of the chains and depends on fiber spinning conditions. Entropic retraction of the chains to their unperturbed dimension produces a macroscopic shrinkage due to the presence of entanglements. Note that the modulus of the entangled network is highly transient and crosslinking is required to maintain the modulus in the melt.

Fibers irradiated with 22.4 Mrad dose shrink only about 35-40% when exposed to 90 C water (row 1 of Table IIa). The reduced level of shrinkage reflects the constraints set forth by the crosslink junctions that prevent complete retraction of oriented chains. In other words, the oriented chains that are in entropic tension put the crosslinked network, formed in oriented state, into a state of compression. The level of ease for the crosslinked melt is dictated by the balance of these two forces. This effect is well known in the literature for rubbers crosslinked in oriented state.

Heat-setting the crosslinked AFFINITY melt at 1× stretch (row 2 of Table IIa) does not change the level of shrinkage when compared to non-heat set fiber, as indicated by $X_{final}$ values. That is because the crosslinked network is permanent and cannot be altered by heat treatment. Similarly, a 3× stretch during heat-setting (row 3 of Table IIa) also does not alter the final level of shrinkage based on original fiber dimension. As an example, if a 10 cm fiber is heat-set while kept at 10 cm (1× stretch), exposure to 90 C reduces the length to 6.5 cm (35% shrinkage), the same with the non-heat set fiber. If the fiber is stretched to 30 cm (3× stretch) and heat-set, the resultant length is 25 cm (2.5× set stretch), but upon exposure to 90 C, the fiber shrinks to 6.5 cm length. This means that there is no heat-setting occurring even though redeniering is possible.

Free shrinkage results for Lycra are given in Table II(b). The shrinkage is minimal for 1.5× stretch however at 3× stretch it is 20% from the heat-set dimension. This would give an overall heat setting efficiency of 34%, which is quite low. Heat set efficiencies and redeniering values measured in our lab were significantly lower than that reported in a recent AATCC Symposium[3] claiming 90% efficiency (presumably at 1.5× stretch). The source of this discrepancy is not known at this time.

Shrink Force Experiments

In shrink force experiments the retractive force at 90 C is measured for stretched fibers that are constrained at both ends. These tests are relevant to shrinkage of fabrics during use, because the dimensions of the elastic fiber will not change significantly once in the fabric, as long as the fabric is dimensionally stable. While this fiber experiment gives an idea about the magnitude of retractive force, how much fabric shrinkage this force will produce is unknown at this time.

The experimental results are given in Table III and are summarized as follows:

- For 3× stretched crosslinked AFFINITY fibers heat-setting does not reduce the retractive force which is about 2.5 g per fiber.
- For Lycra stretched to 3× with no heat setting, the retractive force at 90 C is larger than that of AFFINITY. Unlike AFFINITY, heat-setting for Lycra reduces the retractive force.
- The retractive force for Lycra stretched to 3× and heat-set at 200 C for 1 min is about the same as that for AFFINITY. Longer heat-setting times are needed to reduce the retractive force in Lycra.

The trends for Lycra are in agreement with what is expected: The more efficient the redeniering, the less is the shrinkage. For AFFINITY fibers, the retractive force is a property of crosslinked network that is not expected to relax any further as long as the network remains intact.

Fabric Experiments

Fabrics were made as follows:

The fabrics construction used for the trial, including either greige yarn or yarns which were cone dyed at about 80-90° C., was:

Reed width: 168 cm

Total number of ends: 6136

Yarn count warp: 60/1 meters of cotton per gram or "number metric" or "Nm" (100% cotton)

Number of ends/cm=36

Yarn count weft: 85/1 Nm+78 dtex XLA™ at 4.5×

Number of picks/cm=28

Construction: Plain weave (1:1)

Total number of dents: 1825

Ends/dent: 2

The fabrics were then heated in order to reverse the heat-set. The method to heat the fabric was either a boil off process at 100° C. for fifteen minutes followed by air drying or a wash process at 60° C. followed by tumble drying hot. The results presented in Table IV show that fabrics in which the heat-set has been reversed under milder temperatures have lower width or higher degree of stretch.

TABLE I

Redeniering Efficiency And Boiled-Off Efficiency Of Various Elastic Fibers

| | XLA | | LYCRA | | TPU | |
|---|---|---|---|---|---|---|
| Temp (° C.) | Rednr Eff | HeatSet Eff | Rednr Eff | HeatSet Eff | Rednr Eff | HeatSet Eff |
| 100 | 0.88 | −0.22 | 0.12 | −0.05 | 0.63 | 0.01 |
| 125 | 0.88 | −0.28 | 0.15 | −0.05 | 0.73 | 0.26 |
| 150 | 0.90 | −0.16 | 0.32 | 0.16 | 0.77 | 0.48 |
| 175 | 0.91 | −0.17 | 0.46 | 0.38 | 0.89 | 0.73 |
| 200 | 0.92 | −0.19 | 0.55 | 0.49 | fiber melts | |

TABLE I(a)

Heat Setting Of Lycra

| Exp. ID | Temperature (° C.) | Time | Xapp | Xset | Redenier Efficiency (%) | Calc. New Denier (orig. 70) |
|---|---|---|---|---|---|---|
| L1 | 200 | 1 | 1.0 | 0.99 | n.a | 71 |
| L2 | 200 | 1 | 1.5 | 1.37 | 74 | 51 |
| L3 | 200 | 1 | 2.0 | 1.66 | 66 | 42 |
| L4 | 200 | 1 | 3.0 | 2.05 | 53 | 34 |
| L5 | 200 | 1 | 4.0 | 2.55 | 52 | 27 |
| L6 | 200 | 2 | 3.0 | 2.60 | 80 | 27 |
| L7 | 200 | 3 | 3.0 | 2.60 | 80 | 27 |
| L8 | 210 | 1 | 1.5 | 1.35 | 70 | 52 |
| L9 | 210 | 1 | 3.0 | 2.20 | 60 | 32 |
| L10 | 190 | 1 | 1.5 | 1.25 | 50 | 56 |
| 1-11 | 190 | 1 | 3.0 | 1.84 | 42 | 38 |
| L12 | 180 | 1 | 3.0 | 1.63 | 32 | 43 |

TABLE I(b)

Heat Setting Of Affinity

| Exp. ID | Temperature (° C.) | Time (min) | Xapp | Xset | Redenier Efficiency (%) | Calc. New Denier (orig. 70) |
|---|---|---|---|---|---|---|
| A1 | 200 | 1 | 1.0 | 1.00 | n.a | 65 |
| A2 | 200 | 1 | 2.0 | 1.84 | 84 | 35 |
| A3 | 200 | 1 | 3.0 | 2.50 | 75 | 26 |
| A4 | 200 | 1 | 4.0 | 3.00 | 67 | 22 |
| A5 | 200 | 3 | 2.0 | 1.86 | 86 | 35 |
| A6 | 200 | 3 | 3.0 | 2.55 | 78 | 25 |
| A7 | 175 | 1 | 3.0 | 2.50 | 75 | 26 |
| A8 | 100 | 1 | 3.0 | 2.30 | 65 | 28 |

TABLE II(a)

Free Shrinkage A Experiments At 90 C. For Crosslinked Affinity Fibers

| Condition | Xapp | Xset | Shrinkage (%) | Xfinal | Shrinkage from Orig. Length (%) |
|---|---|---|---|---|---|
| no heat-setting | 1.0 | n.a. | 38 | 0.62 | 38 |
| Heat-set at 200° C. for 1 min | 1.0 | 1.0 | 35 | 0.65 | 35 |
| heat-set at 200° C. for 1 min | 3.0 | 2.5 | 74 | 0.66 | 34 |

TABLE II(b)

Free Shrinkage Experiments At 90 C. For Lycra

| Condition | Xapp | Xset | Shrinkage (%) | Xfinal | Shrinkage from Orig. Length (%) |
|---|---|---|---|---|---|
| no heat-setting | 1.0 | n.a. | 7 | 0.93 | 7 |
| Heat-set at 200° C. for 1 min | 1.5 | 1.37 | 1.2 | 1.35 | n.a. |
| heat-set at 200° C. for 1 min | 3.0 | 2.11 | 20 | 1.68 | n.a. |

TABLE III

Shrink Force Experiments For Crosslinked Affinity And Lycra

| Xapp and Condition | AFFINITY FORCE (grams/fiber) | Lycra Force (grams/fiber) |
|---|---|---|
| 1, no heat-setting | 1.0 | 0.5 |
| 3, no heat-setting | 2.3 | 5.0 |
| 3, Heat-set at 200° C. for 1 min | not measured* | 3.2 |
| 3, Heat-set at 200° C. for 3 min | 2.8 | 1.4 |

*Expected between 2.3 and 2.8 g/fiber.

TABLE IV

Effect of Temperature During Reversal of Heat-set

| Exp. ID | Yarn | Greige Fabric (cm) | 60° C. wash (cm) | Boil off (cm) |
|---|---|---|---|---|
| 4-1 | greige | 147 | 105 | — |
| 4-1 | greige | 147 | — | 123 |
| 4-2 | greige | 145 | 105 | — |
| 4-2 | greige | 145 | — | 121 |
| 4-3 | dyed | 155 | 140 | — |
| 4-3 | dyed | 155 | — | 141 |
| 4-4 | dyed | 158 | 140 | — |
| 4-4 | dyed | 158 | — | 137 |

Although the invention has been described in considerable detail through the preceding embodiments, this detail is for the purpose of illustration. Many variations and modifications can be made on this invention without departing from the spirit and scope of the invention as described in the following claims. All U.S. patents and allowed U.S. patent applications cited above are incorporated herein by reference.

What is claimed is:

1. A method of making a reversed, heat-set elastic fiber comprising:

(a) applying a biasing force to an elastic fiber that will recover at least 50% of its stretched length after the first pull and after the fourth pull of four consecutive pulls to 100% strain, wherein the elastic fiber is a melt spun elastic fiber;

(b) heating the stretched fiber of (a) to a temperature in excess of a temperature at which at least a portion of the crystallites are molten;

(c) cooling the fiber of (b) to a temperature below the temperature of step (b);

(d) removing the biasing force from the fiber; and thereafter (e) heating the temperature of the fiber above a temperature at which at least a portion of the crystallites are molten without a biasing force, such that the length of the fiber obtained in step (e) is less than the length of the fiber obtained in step (d).

2. The method of claim 1 wherein the elastic fiber is fiber is combined with inelastic fiber to form a yarn prior to step (a).

* * * * *